United States Patent [19]

Herd, Jr. et al.

[11] Patent Number: 4,461,731

[45] Date of Patent: Jul. 24, 1984

[54] CARBURETOR

[75] Inventors: William H. Herd, Jr., Fresno; Stanley F. Curtis, Exeter, both of Calif.

[73] Assignee: Pollution Controls Industries, Inc., Tulare, Calif.

[21] Appl. No.: 324,648

[22] Filed: Nov. 24, 1981

[51] Int. Cl.[3] ..... F02M 7/22

[52] U.S. Cl. ..... 261/18 B; 261/71; 261/39 D; 261/67; 261/50 A

[58] Field of Search ..... 261/67, 50 A, 34 A, 261/39 D, 18 B, 71

[56] References Cited

U.S. PATENT DOCUMENTS

| | | | |
|---|---|---|---|
| 1,207,029 | 12/1916 | Guthrie | 261/67 |
| 3,044,751 | 7/1962 | Sarto | 261/23 A |
| 3,249,346 | 5/1966 | Bickhaus et al. | 261/50 A |
| 3,347,536 | 10/1967 | Sutton | 261/34 A |
| 3,409,277 | 11/1968 | Reise | 261/34 R |
| 3,695,589 | 10/1972 | Lamore | 261/23 A |
| 3,695,591 | 10/1972 | Caisley | 261/39 D |
| 3,752,451 | 8/1973 | Kendig | 261/50 A |
| 3,957,026 | 5/1976 | Winkley et al. | 261/39 D |
| 4,021,513 | 5/1977 | Ullman | 261/50 A |
| 4,052,488 | 10/1977 | Schoeman | 261/50 A |
| 4,052,490 | 10/1977 | Fedison | 261/67 |
| 4,056,583 | 11/1977 | Shinoda et al. | 261/DIG. 56 |
| 4,117,810 | 10/1978 | John | 261/18 R |
| 4,150,070 | 4/1979 | Hashimoto et al. | 261/67 |
| 4,154,782 | 5/1979 | Sherwin et al. | 261/67 |
| 4,275,015 | 6/1981 | Delden | 261/71 |
| 4,283,355 | 8/1981 | Herd, Jr. et al. | 261/50 A |
| 4,340,549 | 7/1982 | McKim | 261/18 R |

*Primary Examiner*—Tim R. Miles
*Attorney, Agent, or Firm*—Huebner & Worrel

[57] ABSTRACT

An improved carburetor having a mixing passage adapted for connection to an internal combustion engine, a pair of venturi plates pivotally mounted in the passage positioned in response to vacuum generated by the engine, a fuel spray bar extended across the passage, a primary fuel system for supplying a primary fuel to the bar automatically controlled in response to the positions of the plates, and an enrichment fuel system for supplying an enrichment fuel to the bar automatically controlled in response to the positions of the plates independently of the primary fuel system.

10 Claims, 12 Drawing Figures

CARBURETOR

BACKGROUND OF THE INVENTION

1. Field of the Invention

The present invention relates to an improved carburetor, and more particularly to a carburetor having pivotally mounted plates, which define a variable venturi, and a fuel metering system coordinated with the pivotal positions of the plates, the improvement relating to an enrichment fuel system usable, for example, for metering fuel during starting and cold weather conditions, for metering fuel during relatively high engine power requirements, and to condition the carburetor for different types of fuel.

2. Description of the Prior Art

The prior art includes carburetors characterized by having a housing providing a rectangular mixing passage leading to an internal combustion engine and a fuel chamber at one side of the passage, by having a throttle at the downstream end of the passage, by having a fuel spray bar extended transversely across and centrally of the passage, and by having a pair of venturi plates pivoted for movement about axes parallel to the bar and individually adjacent to a pair of opposite walls of the passage, the plates having a closed position in which they extend from their respective axes toward each other and across the passage and an open position extended in the direction of air flow along the passage. In such prior art carburetors, the plates are moved toward the open position by air flow toward the engine, this movement being resiliently opposed and coordinated by elements linking the plates. These carburetors are further characterized by a fuel metering system which includes a valve operably connected to the plates so as to be progressively opened and closed as the plates move, respectively, toward their open and their closed positions.

Examples of such venturi plate carburetors are disclosed in the Kendig U.S. Pat. No. 3,752,451 and in U.S. Pat. No. 4,283,355 to Herd, Jr., et al. The carburetors disclosed in these patents are characterized by their adaptability without significant alteration to a wide range of engines and operating conditions, by providing an even fuel distribution at the exit from the mixing passage, and by providing a desired fuel to air ratio over a wide range of air flow. The carburetor of the latter patent is particularly effective in providing even fuel distribution and proper fuel/air ratio at low and medium air flow.

It nevertheless has been recognized as desirable further to increase the adaptability and flexibility of performance of such carburetors by adapting an individual carburetor for use, without significant disassembly or machine work, to conditions requiring greatly increased fuel flow to enrich the fuel/air mixture provided by the carburetor. One example of such a use is in starting and/or cold weather. Another example is in an engine for use in a racing automobile or the like where a rich mixture is used to provide increased power and where conventionally precise adjustments are required for varying atmospheric conditions. A further example is in racing where methanol fuel is used, the mass rate of flow with such fuel being approximately double that of gasoline. Since a racing engine may be used at different times with various fuels, a carburetor for a racing engine which has the advantages of prior art venturi plate carburetors and which is easily, economically, and completely convertible from one fuel to another in a few minutes is highly desirable. Another example is the need to provide, for maximum power, an enriched mixture to an internal combustion engine normally operated at a relatively lean mixture for economy, as is usually the case with vehicle engines for street use. A further example is the use of ethanol and gasoline mixtures in engines for street use where, although operation is possible without alterations to a carburetor intended for gasoline only, superior performance from the standpoints of cruising economy and maximum power is possible only by varying the fuel to air ratios under these two conditions from the relative such ratios provided by a carburetor intended for use with gasoline only.

SUMMARY OF THE INVENTION

It is an object of the present invention to provide an improved venturi plate carburetor which is easily and economically adapted to provide increased fuel flow under a variety of conditions.

Another object is to provide such a carburetor wherein an enriched mixture is supplied for starting and/or cold weather conditions under manual control or, alternatively, under automatic control.

Another object is to provide such a carburetor usable with a racing engine and, in such use, rapidly convertible between various fuels, such as gasoline and alcohol.

Another object is to provide such a carburetor for use with a street vehicle which automatically supplies a relatively rich fuel/air mixture for maximum power operation and supplies a relatively leaner mixture for cruising operation.

Another object is to provide such a carburetor wherein an element for metering such increased fuel flow is easily replaced with a similar element to provide a different flow, such replacement not requiring alteration or significant disassembly of the carburetor.

Another object is to provide such an improved carburetor wherein the improvements are embodied in elements which are adapted for use in existing venturi plate carburetor structures and which require minimal alteration to such existing structure to provide the above-stated objects.

A still further object is to provide improved elements and arrangements thereof in an improved venturi plate carburetor which is adapted to a variety of internal combustion engines and operating conditions thereof requiring an enriched fuel to air ratio and which is dependable and fully effective in performing its intended purpose.

DESCRIPTION OF THE PREFERRED EMBODIMENT

First Form

Figure 2:
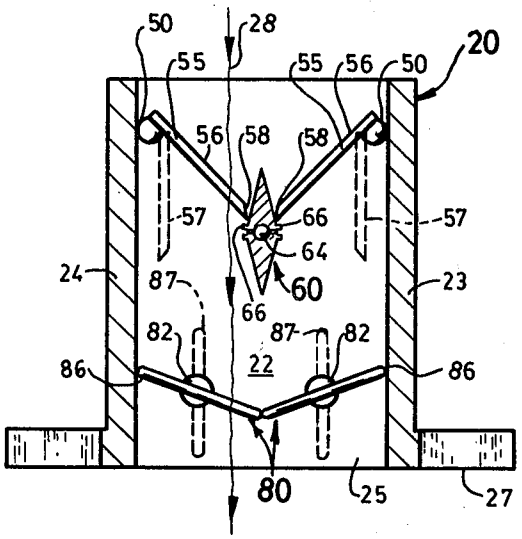
FIG. 2 is a vertical section of the carburetor taken on line 2—2 of FIG. 1.
Figure 1:
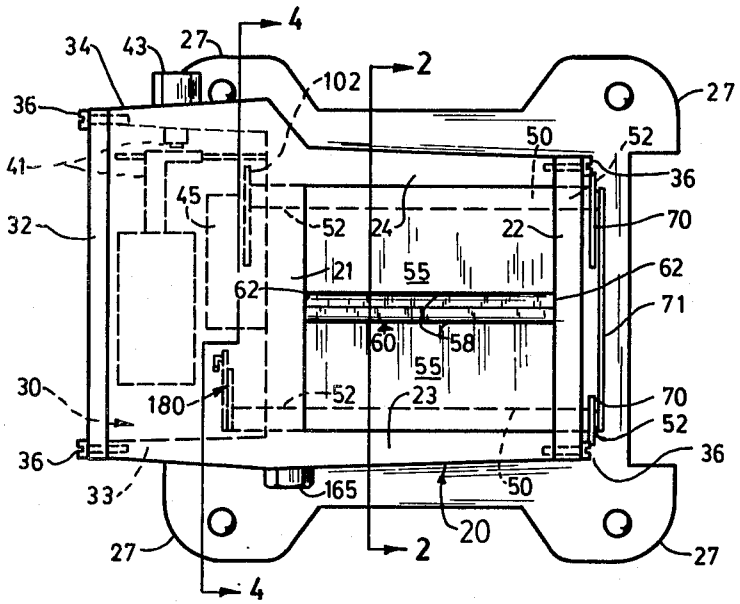
FIG. 1 is a top plan view of a first form of an improved carburetor which embodies the principles of the subject invention.
Figure 3:
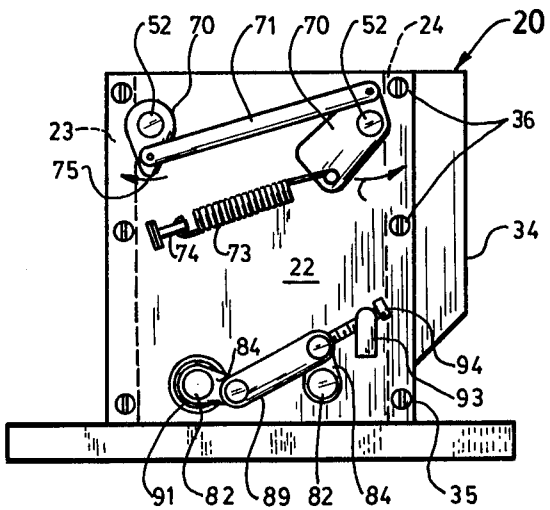
FIG. 3 is an end elevation of the carburetor.

Referring with greater particularity to the drawings, in FIGS. 1, 2, and 3 is shown an improved carburetor embodying the principles of the subject invention. The carburetor is similar to that described and shown in the above-mentioned U.S. Pat. No. 4,283,355 to Herd, Jr., et al and only those elements necessary for understanding the subject invention are described herein, other structure and functions of the carburetor being fully disclosed in such patent.

The carburetor has a housing indicated generally by the numeral 20. The housing has four planar walls, 21 through 24, disposed in a box-like arrangement so as to define a throat or mixing passage 25 which is of rectangular cross-section and extends through the housing. The wall 21 is a first one of the walls, and the wall 22 is a second wall which is disposed parallel to the first wall and oppositely of the passage from it. The walls 23 and 24 are, respectively, a third wall and a fourth wall which are a pair of opposite walls normal to the first wall and the second wall. The housing is provided with lugs 27 at one end of the mixing passage for mounting the carburetor on an internal combustion engine, not shown. The carburetor is adapted for air flow to the engine through the mixing passage in a direction indicated by the arrow 28 in FIG. 2, the air being drawn in such direction in the well-known manner by the engine when it is in operation. The depicted embodiment of the subject invention is a downdraft carburetor so that this direction is generally vertical and downward, the lugs thus being at the bottom of the carburetor.

The carburetor has a fuel chamber 30 mounted on the first wall 21 oppositely of the passage 25. The first wall is thus common to the passage and the chamber and the chamber is disposed at one side of the passage. The chamber has a detachable cover 32, which is congruent with and parallel to the first wall, and has four side walls 33 extended between the first wall and the cover. The chamber has a hump-like extension 34 disposed horizontally outwardly of the fourth wall 24 in a direction opposite to the third wall 23. Typically, the walls 21, 23, 24 and 33 are integral, and the wall 22 and the cover 32 are secured thereto in any suitable manner, as by screws 36. The chamber is provided with a float and valve assembly 41 disposed at such extension. This assembly is of well-known construction for supplying liquid fuel to the chamber to maintain a fuel level 42 therein. The assembly has a fitting 43 for connection to any suitable source, not shown, of such fuel. The first wall 21 has a boss 45 projecting centrally thereof into the chamber for a purpose subsequently to be described.

The carburetor has a pair of parallel, generally cylindrical, venturi plate shafts 50. The axes of these shafts are normal to the first wall 21 and to the second wall 22 and are parallel to the pair of walls 23 and 24. The axes of the shafts are thus normal to the downward direction 28 of air flow in the mixing passage 25. The shafts extend across this passage and are adjacent to its upper end and are individually adjacent to such pair of walls. Each shaft has opposite end portions 52. These portions of each shaft are axially spaced and extend individually through the first wall and the second wall, the portions being journaled in these walls for pivotal movement of the shaft about its axis. Each end portion extends somewhat beyond the corresponding wall in a direction opposite to the mixing passage. Each shaft thus has one such end portion which extends through the first wall and is disposed within the fuel chamber 30.

The carburetor has a pair of rectangular venturi plates 55 individually mounted on the shafts 50 within the passage 25 for pivotal movement with the shafts. Each plate pivots between a fully closed position 56 and a fully open position 57 which is depicted in dashed lines in FIG. 2. Each plate has a pair of opposite edges which are parallel to the walls 21 and 22. One edge of the other pair of opposite edges of each plate extends along the corresponding shaft and is secured rigidly thereto in any suitable manner. The remaining edge 58 of each plate is a distal edge which is parallel to the corresponding shaft and is spaced therefrom. In the closed positions, each distal edge is disposed in the direction 28 of air flow from the corresponding shaft and is disposed centrally of the passage in spaced relation to the distal edge of the other plate so that the plates extend generally across the passage 25. In their closed positions, the plates extend downwardly from the shafts and generally parallel to the direction of air flow. It is apparent that air flow through the passage urges the plates toward their fully open position and that the plates are pivotally mounted in the passage for pivotal movement between relatively open and closed positions intermediate of the positions 56 and 57.

Figure 5:
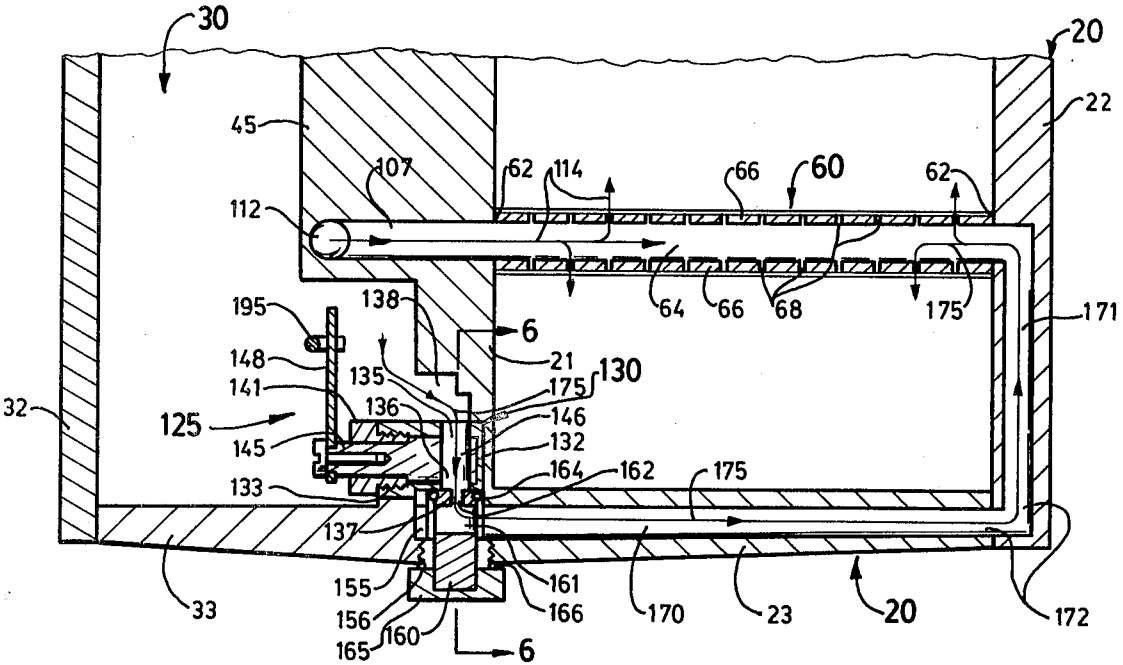
FIG. 5 is a generally horizontal somewhat enlarged section of the carburetor taken on line 5—5 of FIG. 4.

The carburetor has an elongated spray bar 60, best shown in FIGS. 1, 2 and 5, disposed within and extended across the mixing passage 25 in a direction parallel to the shafts 50. The bar has a pair of opposite ends 62 which individually engage the walls 21 and 22, the bar being clamped between these walls in fluid-tight relation thereto and thus being mounted on the housing 20. The bar is disposed centrally between the third wall 23 and the fourth wall 24 and has a fuel channel 62 extended longitudinally through it, the channel thus having a pair of opposite ends corresponding to the ends of the bar. The bar is of lozenge-like cross-section with its acute angles upwardly and downwardly disposed so that the bar has opposite sides 66 disposed individually toward the third wall and the fourth wall. The bar is disposed in the passage so that the distal edges 58 of the plates 55 are individually closely adjacent to these sides when the plates are in their closed positions 56. The channel extends centrally between these sides and the bar has a multiplicity of nozzles or ports 68 opening from the channel into the mixing passage, the ports being spaced along the bar in two rows individual to the sides of the bar.

Referring to FIG. 3, it is seen that the shaft portions 52 which extend through the second wall 22 bear individual levers 70. Each lever is rigidly connected to the corresponding portion for pivotal movement therewith and the levers are interconnected by a link 71 having a pair of opposite ends individually pivotally connected to the levers. The levers and link are proportioned and arranged to coordinate the pivotal movement of the shafts so that the plates 55 move correspondingly between their closed positions 56 and open positions 57. The carburetor has a tension spring 73 which extends from the one of these levers which is adjacent to the wall 24 to an anchor 74. The anchor is mounted on the wall 22 and is adjacent to the wall 23. As the plates move toward the open positions under the urging of air flow in the direction 28, the levers pivot as indicated by the arrows 75 and the spring is tensioned and resiliently urges the plates toward their closed positions in opposition to the air flow.

The carburetor has a pair of rectangular, plate-like throttles 80 shown in FIG. 2. The throttles are disposed in the passage 25 at its lower end and are, therefore, spaced in the direction 28 from the shafts 55 and from the spray bar 60. Each throttle has a shaft 82 which is parallel to the shafts 55 and which has opposite axial ends individually journaled in the first wall 21 and in the second wall 22 for pivotal movement therein. The end journaled in the first wall does not extend into the chamber 30. However, the other end extends through the wall 22 and is provided with an individual lever 84 disposed oppositely of the second wall from the passage 25. The throttles and the levers are fixedly mounted on the corresponding throttle shafts for pivotal movement therewith. Each throttle is thus mounted on the housing for movement between a closed position 86, in which the throttles substantially block the passage, and an open position 87, which is depicted in dash lines in FIG. 2. The levers are connected by a link 89 which extends between the levers and is individually pivotally connected thereto. The levers and the link are dimensioned and proportioned so that the throttles move together between their respective open and closed positions. A spiral spring 91 is disposed about the one of the throttle shafts adjacent to the wall 23 and is adapted to urge the throttles toward their closed positions. The throttles, typically, are connected to an accelerator pedal, not shown, by any suitable linkage, also not shown, attached to one of the levers 84. The second wall has an ear 93 extended therefrom adjacent to the one of the levers toward the wall 24, and an idle speed screw 94 is screw-threadably engaged with the ear. The screw extends through the ear toward this one lever for engagement therewith to prevent the throttles from completely attaining their closed positions. Rotation of the screw thus adjustably controls, in a well-known manner, the idle speed of an engine connected to the passage 25.

Figure 4:
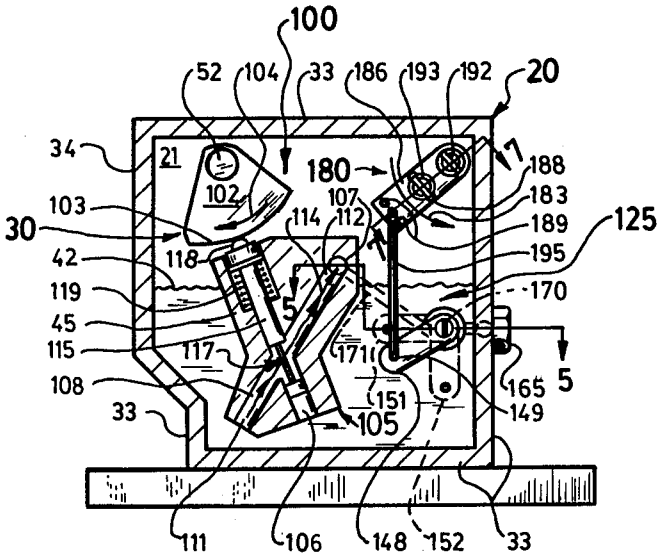
FIG. 4 is a vertical section of the carburetor taken on line 4—4 of FIG. 1.

The carburetor has a primary fuel supply or metering system indicated generally by the numeral 100 and best shown in FIGS. 4 and 5. This system includes a cam 102 mounted on the one of the end portions 52 which is within the chamber 30 and is adjacent to the wall 24. The cam is generally arcuate and its center is coincident with the axis of the corresponding shaft 50. The cam extends radially from the shaft and terminates in an edge 103 disposed toward the boss 45. The cam is secured to the shaft in any suitable manner for pivotal movement therewith. The cam pivots in the direction indicated by the arrow 104 in FIG. 4 as the plates 55 move from their closed positions 56 to their open positions 57. If desired, the cam can be detachably connected to the shaft and its angular position relative thereto be made adjustable. It is evident that, as the cam pivots with the shaft, each pivotal position of the cam about the axis of the shaft corresponds to a position of the plates 55 between their closed positions 56 and open positions 57, the position of the cam depicted in FIG. 4 corresponding to positions of the plates intermediate of such positions.

The system 100 includes within it a primary fuel control valve which is indicated generally by the numeral 105 and is disposed in the boss 45. This valve thus is mounted on the first wall 21 of the housing 20 within the fuel chamber 30. The valve includes a first bore 106 which extends entirely through the boss parallel to the first wall, the axis of this bore being disposed in radial and intersecting relation to the edge 103 of the cam 102. The portion of this bore disposed toward the cam is of somewhat larger diameter than the balance of the bore. The valve has a second bore 107, which is a primary fuel passage of the first form of carburetor. The second bore extends through the first wall from the corresponding one of the ends of the channel 64 of the spray bar 60 to a point aligned with the first bore. The valve has a third bore 108 which extends through the boss from the second bore in intersecting relation to the first bore and opens into the chamber oppositely of the first bore from the second bore. The valve has an inlet 111 for the reception of fuel from the chamber where the third bore opens into the chamber. The valve has an outlet 112 where this bore opens into the second bore, which in turn, extends to the one end of the channel 46. It is evident that the elements of the system 100 just described interconnect the chamber and the one of the spray bar ends 62 at the first wall. It is also evident that these elements provide for a primary fuel flow, indicated by the arrows 114, between the chamber and this one end, the flow continuing from this one end to the ports 68.

The valve 105 has a spindle 115 having a lower portion, which is closely slidably fitted in the smaller diameter portion of the first bore 106, and an upper portion of larger diameter which is received in the larger diameter portion of this bore. This lower portion has an annular groove 117 disposed at the intersection of the first bore and the third bore 108. The upper portion of the spindle has a hemispherical protuberance 118 disposed toward the edge 103 of the cam 102 and maintained in engagement therewith by a compression spring 119 which circumscribes the spindle and extends axially between its upper portion and the smaller diameter portion of the third bore. It is evident that the cam serves to actuate the spindle in response to pivotal movement of the one of the shafts 50 to which the cam is connected and that the protuberance and the spring serve to actuate the valve in response to such pivotal movement. The edge of the cam has a configuration such that the point on this edge engaged by the protuberance recedes progressively from the boss 45 as the cam moves in the direction 104. The groove 117 is disposed axially along the spindle so that the spindle nearly closes the third bore when the cam is in a position corresponding to the closed positions 56 of the venturi plates 55 and progressively opens this bore as the cam pivots in the direction 104. It can be seen that the primary fuel flow 114 is relatively restricted when the bore is so closed and becomes progressively less restricted as the bore is progressively opened. It is evident then, that the cam and the shaft portion 52 mounting the cam serve to link and to interconnect the primary valve 105 and the one of the venturi plates 55 which is mounted on the shaft having such portion so that the valve opens and closes in response to the opening and closing of the plates. This opening and closing of the valve thus occurs automatically in response to the movement of the plates. Since the edge of the cam recedes progressively from the boss as the plates open progressively to unblock the third bore, it is evident that the valve opens progressively as the plates move towards their open positions and that the valve progressively closes as the plates move towards their closed positions.

The elements of the carburetor heretofore described, and the functions and interrelations of these elements, generally correspond to elements, functions, and interrelations, shown and described in the above-identified U.S. Pat. No. 4,283,355. However, the elements now to be described constitute the new and improved portion of the carburetor and constitute an enrichment fuel supply or metering system indicated generally by the numeral 125 having unique advantage when combined with the previously described primary fuel system 100. Fuel supplied to the spray bar 60 by this system is added to the quantity of fuel supplied by the primary system so that a mixture of fuel and air being supplied by the carburetor is richer than if no fuel were being supplied by the enrichment system. The enrichment system is, accordingly, identified by the word "enrichment" although the mixture of fuel and air supplied to an internal combustion engine by a carburetor embodying the subject invention may or may not be a "rich" mixture in relation to the stoichiometric ratio of such fuel and air.

Figure 6:
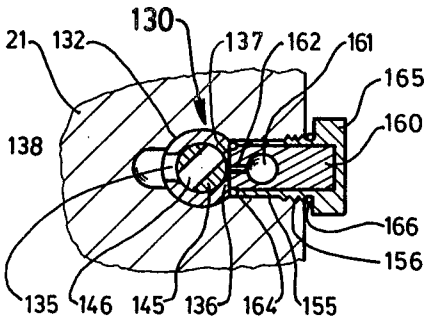
FIG. 6 is a fragmentary section of the carburetor taken from the position of line 6—6 of FIG. 5.

The enrichment system 125 has a rotary enrichment control valve 130, best shown in FIGS. 4, 5, and 6, mounted on the first wall 21 of the housing 20. The valve has a cylindrical bushing 132 fixed in this wall in position below the fuel level 42 and adjacent to the wall 23. The axis of the bushing is parallel to the axes of the shafts 50. The bushing has an internally screw-threaded open axial end 133 disposed toward the chamber, the opposite end of the bushing being closed. The bushing has a pair of bores 135 and 136 which are of equal diameter and are diametrically opposite of the bushing and are themselves axially aligned. The bore 136 is an outlet of the valve, and the periphery of the bushing has an annular, planar surface 137 circumscribing this bore. The first wall is provided with a groove 138 leading from the chamber 30 to the bore 135 which is thus an inlet to the valve. The valve has a plug 141 which is screw-threadably engaged in the screw-threaded end of the bushing and which has a bore coaxially related to the bushing.

The valve 130 has a cylindrical rotor 145 having a larger diameter portion which is closely rotationally fitted within the bushing 132 and is provided with a metering bore 146. This bore is aligned axially of the bushing with the bores 135 and 136 and is substantially equal in diameter to these bores. The rotor has a stem extended through the bore of the plug 141. The valve has a lever 148 fixedly mounted on the stem in any suitable manner outwardly of the bushing for rotation with the rotor. The lever extends from the stem in a direction radial to the bushing and generally toward the boss 45. The lever is provided with a bore 149 extended through it and spaced from the stem for a purpose subsequently to be described. The lever moves in an arcuate path between an upper position 151 and a lower position 152, these positions being depicted in dash lines in FIG. 4. The lever is mounted on the stem in an angular relation to the axis of the metering bore 146 such that this bore is aligned with the pair of bores 135 and 136, as shown in FIG. 5, when the lever is in the lower position, the valve 130 then being fully open, and so that the metering bore does not communicate with this pair of bores when the lever is in its upper position, the valve then being fully closed.

The enrichment system 125 includes a generally cylindrical cavity 155, shown in FIGS. 5 and 6, extended through the first wall 21 in axial alignment with the bores 135 and 136 of the bushing 132. The cavity extends from the bushing to the exterior of the third wall 23. The cavity is aligned with and is substantially equal in diameter to the periphery of the annular surface 137, and the outer end of the cavity is provided with internal screw threads 156.

The system 125 includes a cylindrical orifice block 160 which is coaxially received in the cavity 155. The periphery of the block is substantially smaller in diameter than the cavity, and the block is substantially longer axially than the cavity so as to protrude therefrom exteriorly of the third wall 23. The block has a bore 161 extended diametrically through it, and has a metering orifice 162 extended axially of the block into this bore from the end of the block toward the bushing 132. This end of the block is somewhat smaller in diameter than the balance of the block and is circumscribed by an O-ring 164 of resilient, compressible material. The system includes a cap 165 which is coaxially fitted into the cavity and which screw-threadably engages the screw threads 156. Interiorly, the cap is slidably fitted to the block and, exteriorly of the third wall, has a head adapted for engagement with a turning tool, not shown. Another O-ring 166 of resilient, compressible material circumscribes the cap and is disposed between such head and the exterior of the third wall. When the cap is screwed into the housing 20, the O-ring 164 seals the block to the valve 130 so that fuel flowing from the bore 136 must pass through the orifice. The O-ring 166 seals the cavity in fluid-tight and air-tight relation to the exterior of the housing. It is evident that, when the cap is unscrewed from the housing, the block is accessible from a position exteriorly thereto. The block is thus accessible for detachment and removal from the housing for convenient replacement with another and interchangeably constructed block having an orifice which is similar to the orifice 102 but which has different fuel metering characteristics.

The enrichment system 125 has a bore 170 which is parallel to the shafts 50 and which extends from the cavity 155 through the third wall 23 to the second wall 22. This system has a channel 171 which is disposed in the second wall 22 and which has opposite ends communicating individually with such bore and with the end of the fuel channel 64 at the spray bar end 62 which is adjacent to and is engaged with the second wall. This end of the spray bar 60 is, of course, the end thereof opposite to the end to which the primary system 100 is connected. It is apparent that the bore 170 and channel 171 define an enrichment fuel passage 172 extended through the housing 20 between the bore 136 of the enrichment valve 130 and the fuel channel 64 so that an enrichment fuel flow, indicated by the arrows 175 in FIG. 5, can flow from the chamber 30 through the valve 130, the cavity 155, and such passage to the ports 68 of the spray bar. The enrichment system thus interconnects fuel within the chamber 30 with the bar so that the enrichment flow is in parallel with the primary flow 114.

It is apparent that the cavity 155 is disposed in intersecting relation with the enrichment passage 172 and that the block 160 is therefore disposed in obstructing relation with this passage. The orifice 162 in the block is thus in series relation with the enrichment flow 175 between the chamber 30 and the spray bar 60, and it can be seen that this orifice meters such flow in series with the metering of such flow by the enrichment valve 130.

Figure 7:
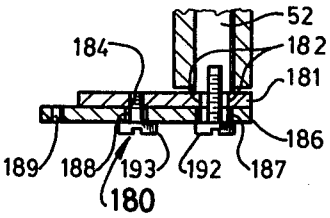
FIG. 7 is a fragmentary somewhat enlarged section taken on line 7—7 of FIG. 4.

The carburetor embodying the improvements constituting the first form of the subject invention is distinguished from other forms thereof, which are subsequently to be described, by reference to FIGS. 4 and 7. The first form has an adjustable lever mechanism 180 mounted on the other of the shafts 50 than the one thereof mounting the cam 102 of the primary fuel system 100. This mechanism includes a fixed planar lever 181 mounted on such other shaft at the portion 52 thereof which extends into the chamber 30. This portion of the shaft is provided with opposite flats 182 which are fitted to a conforming opening in the fixed lever so that this lever cannot pivot independently of the shaft. The length of this fixed lever is somewhat less than the length of the enrichment valve lever 148, and the fixed lever extends radially from the shaft and centrally of the chamber 30. The flats are disposed on the shaft so that this lever extends approximately horizontally when the plates 55 are in their closed positions 56 and pivots downwardly, as indicated by the arrow 183, as the plates move toward their open positions 57. The fixed lever is provided with a screw-threaded bore 184 which is parallel to the shaft and is spaced radially therefrom. The mechanism has a second planar lever 186 which is generally parallel to the fixed lever 181 and is disposed above the lever 148. The second lever is flatly engaged with the fixed lever at the side thereof opposite from the first wall 21. The second lever has an arcuate slot 188 aligned with the screw-threaded bore of the fixed lever, and has three arcuately arranged bores 189 spaced outwardly of this slot. The mechanism has a screw 192 which is coaxially related to the shaft and is screw-threadably engaged in the end thereof and has another screw 193 which extends through the slot 188 and is screw-threadably engaged in the bore 184. It can be seen that, if these screws are loosened, the second lever can move angularly in relation to the fixed lever so that the angular relation between the second lever and the corresponding venturi plate 55 can be adjusted within the limits provided by the length of the slot. This relation is maintained by tightening these screws.

The carburetor has a rod 195 having opposite ends individually pivotally received in one of the bores 189 and in the bore 149 of the lever 148. It is evident that this rod and the mechanism 180 serve as a linkage connecting the venturi plates and the enrichment valve 130 so that, as the venturi plates 55 move progressively toward their open positions 57, this lever pivots in a direction from its upper position 151 towards its lower position 152 and the enrichment valve is progressively opened in response to the opening of the venturi plates. Conversely, as the plates move progressively in a direction from their open position to their closed position, the enrichment valve is progressively closed. It is evident that such opening and closing occurs automatically as the plates move pivotally in response to changes in the air flow 28. It should be noted that, by adjusting the angular relation between the levers 181 and 186 as above described and/or by selecting the one of the bores 189 which receive the rod 195, the relative angular position between the bores 135 and 136 of the enrichment valve and its rotor 145 can be varied in relation to any selected position of the venturi plates. Access to the mechanism 180 to perform such adjustment and selection is conveniently obtained by removing the cover 32 after removing the appropriate screws 36. As a result, the enrichment valve, selectively, can be made to open and close simultaneously with the plates and the primary valve 105, or the opening of the enrichment valve can be delayed until the plates and the primary valve have opened to any desired extent. The enrichment fuel flow 175 can, in any event, be limited as described by selection of a block 160 having an orifice 162 of the requisite flow characteristics.

Second Form

Figure 9:
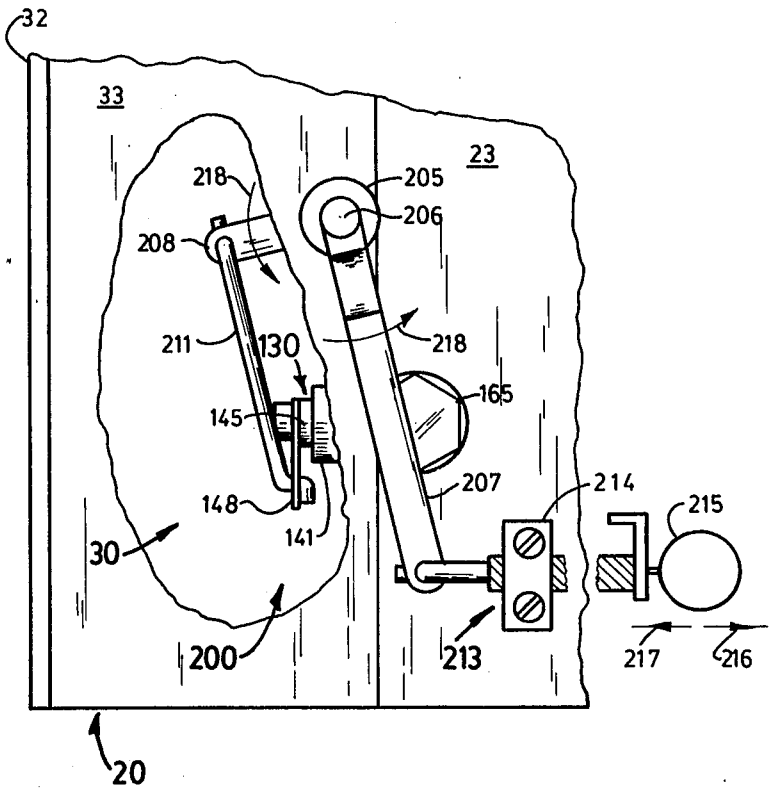
FIG. 9 is a fragmentary view of the second form, including elements for manual actuation and with a portion broken away to show the interior, taken from the position of line 9—9 of FIG. 8.
Figure 8:
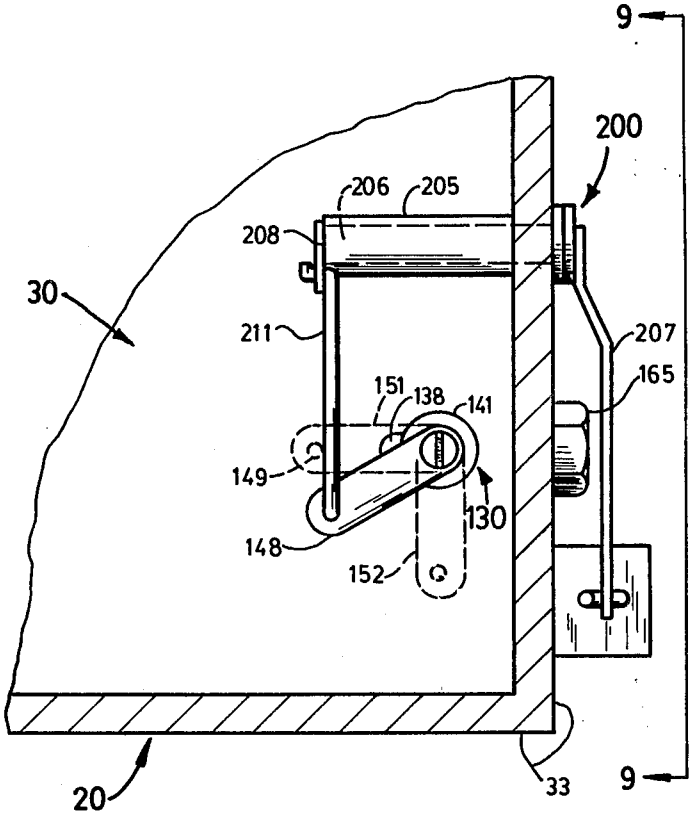
FIG. 8 is a fragmentary section, which is taken from a position similar to that of FIG. 4 but on an enlarged scale, of a second form of carburetor embodying the subject invention.

A carburetor embodying a second form of the subject invention is illustrated in FIGS. 8 and 9. The second form is distinguished structurally from the first form in that the second form has a manually actuatable linkage 200 for progressively opening and closing the enrichment valve 130 and does not include the mechanism 180 and link 195, all other elements of the second form being substantially identical to those of the first form and being identified by identical numerals.

The linkage 200 includes a bushing 205 disposed above the fuel level 42 and mounted in the one of the side walls 33 which is aligned with the third wall 23. A shaft 206 extends through the bushing in a direction normal to the side wall for pivotal movement relative thereto. The linkage includes an outer arm 207 and an inner arm 208 which extend radially from the shaft and are fixedly mounted thereon for movement therewith. These arms are disposed, respectively, externally of the housing 20 and within the chamber 30. The linkage has a rod 211 having opposite ends pivotally received in the inner arm and the bore 149 of the enrichment valve lever 148. The linkage 200 thus extends from the enrichment valve 130 to a point exterior to the housing 20. The linkage includes a manually actuatable cable assembly 213 of well-known construction. The assembly has one end provided with a clamp 214, which secures this end to the third wall, and has an opposite end provided with a manually operable knob 215. The assembly is connected to the outer arm so that the enrichment valve is progressively opened and is progressively closed by progressive movements of the knob, respectively, in the directions indicated by the arrows 216 and 217, movement of the arms 207 and 208 corresponding to opening of the valve being indicated by the arrows 218. The range of such movements provided by the linkage 200 is such that the lever 148 is positionable at either of its positions 151 or 152 and, at any position therebetween. As a result the second form provides complete manual control over the metering of the enrichment flow 175 by the enrichment valve, such flow being also metered by the orifice 162.

Third Form

Figure 10:
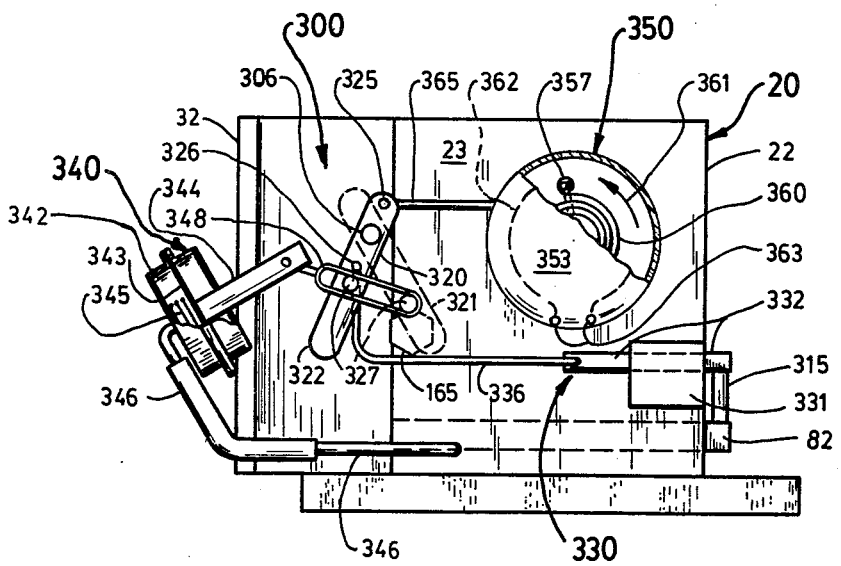
FIG. 10 is a side elevation of a third form of carburetor embodying the principles of the subject invention, portions of the carburetor being broken away for illustrative convenience.
Figure 11:
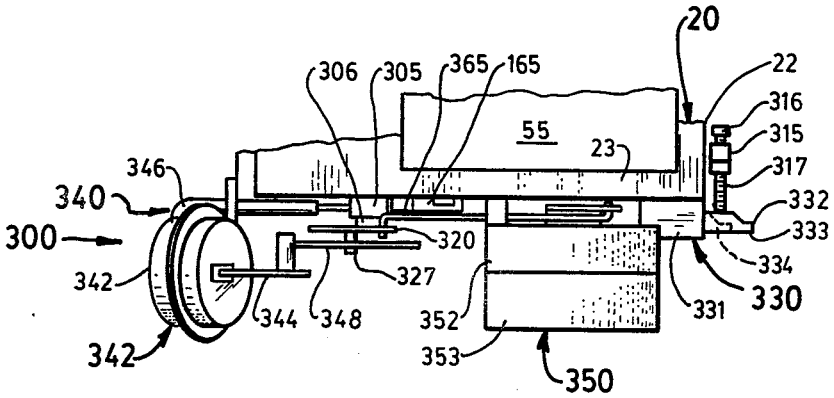
FIG. 11 is a fragmentary plan view of the third form of carburetor.
Figure 12:
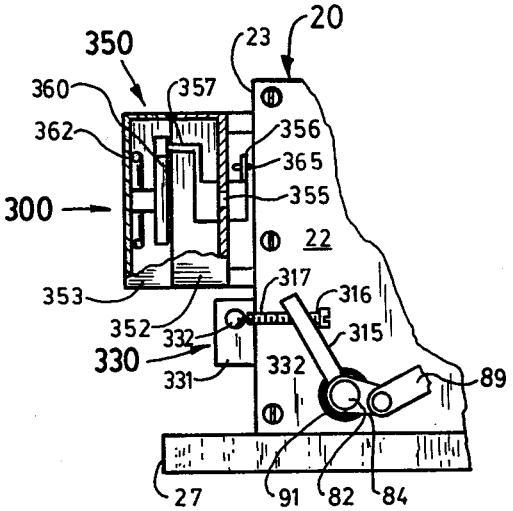
FIG. 12 is a fragmentary end elevation of the third form of carburetor with a portion broken away to show the interior.

A carburetor embodying the third form of the subject invention is depicted in FIGS. 10, 11, and 12. The third form has the elements which are described in connection with the second form as being common to the first and second form and these elements are indicated by the numerals heretofore used. The third form is distinguished from the first form and from the second form by having an apparatus, indicated generally by the numeral 300, mounted exteriorly of the housing 20 at the side thereof corresponding to the third wall 23. The apparatus is characterized by its automatic actuation of the enrichment valve 130 under cold weather conditions and/or when an engine, to which the third form of carburetor is connected, is being started. The apparatus has a bushing 305 and a shaft 306 together with an inner arm, not shown, and a rod, not shown, these four elements being substantially identical, respectively, to the elements 205, 206, 208, and 211 of the Second Form.

The third form is also distinguished from the first and second forms by having an arm 315 mounted on the one of the throttle shafts 82 adjacent to the third wall 23 for movement with this shaft. The arm extends radially upwardly from the shaft when the throttles 80 are in their positions which are determined by the screw 94 and which are near their closed positions 86. A fast idle speed screw 316 is screw-threadably engaged with this arm and extends generally horizontally therethrough. This screw has an axial end 317 which projects somewhat outwardly of the third wall when the throttles are in the position determined by the screw 94.

The apparatus 300 has a lever 320 mounted on the shaft 306 exteriorly of the housing 20 for pivotal movement with the shaft. As shown in FIG. 10, this lever pivots between a first extreme position 321, which is depicted in dashed lines in FIG. 10 and in which the enrichment valve 130 is fully opened, and a second extreme position 322, in which this valve is closed. This lever extends generally parallel to the third wall 23 and is spaced somewhat therefrom. The lever extends generally upwardly and downwardly and in diametrically opposite directions from the shaft. The lever has an upper bore 325 disposed above the shaft, has a lower bore 326 disposed below the shaft, and bears a cylindrical pin 327 which projects from the lever and which is disposed downwardly of the lower bore, the axes of these bores and the pin being parallel to the shaft 306.

The apparatus 300 has a fast idle mechanism 330 which includes a guide 331 mounted on the third wall 23. The guide is adjacent to the arm 315 and a bore extends horizontally through the guide. The mechanism has a fast idle cam 332 slidably fitted in this bore for movement axially therein between a fast idle position 333 and a normal idle position 334 which is depicted in dashed lines. The cam has a ramp disposed for engagement by the end 317 of the screw 316. The ramp has a configuration such that the cam is disengaged from the screw end when the cam is in its normal idle position and such that the cam engages the screw when the cam is toward its fast idle position. As a result of the engagement, the throttles 80 cannot move completely into the position determined by the screw 94 when the cam is in its fast idle position. When the cam and the fast idle speed screw 316 engage, the throttles are in a position near their closed position 86, so that a desired fast idle position of the throttles is obtainable by adjustment of the fast idle screw. A rod 336 extends from the cam, at a point which is opposite of the guide from the fast idle screw, to the bore 326 of the lever 320. The length of the rod is such that the fast idle cam is moved into the fast idle position as the lever moves into its position 321 and such that the cam is moved into the normal idle position as the lever moves into its position 322. The rod has a curved configuration so as not to interfere with other elements shortly to be described.

The apparatus 300 has an unloader device 340 which includes a diaphragm assembly 342. The assembly includes a cylindrical case mounted in any suitable manner on and outwardly of the one of the side walls 33 adjacent to the lever 320. A diaphragm 343 is disposed centrally and coaxially in the case and a rod 344, which is mounted on the diaphragm for movement therewith, extends from the case in a direction generally toward the lever. The assembly includes a compression spring 345 which extends between the case and the diaphragm and urges the diaphragm and rod toward the lever. The side of the diaphragm toward the lever is open to the atmosphere. The opposite side is interconnected by any suitable conduit 346 to the mixing passage 25 at a point downwardly of the throttle shafts 82. This point is thus between the throttles 80 and an engine provided with the third form of carburetor. The unloader device includes a slotted link 348 which is pivotally connected to the rod 344 and extends therefrom so that the pin 327 is received in the slot of this link. As shown in FIG. 10, the slot is proportioned so that the end of the slot remote from the diaphragm engages the pin when atmospheric pressure is present on both sides of the diaphragm and when the lever is in its position 321 in which the enrichment valve 130 is fully opened. As a result, when a vacuum is applied to such opposite side of the diaphragm, the link is urged toward the case so as to engage the pin and move the lever 320 somewhat from its position 321 toward its position 322. The slot allows the lever to complete such movement regardless of the position of the diaphragm and the relative pressures in its opposite sides.

The apparatus 300 has a thermostat unit 350. This unit is disposed on and outwardly of the third wall 23 and above and adjacent to the guide 331. This unit includes a cylindrical case having an inner portion 352 of cup-like configuration. This portion is fixedly mounted on the third wall and is spaced therefrom by suitable legs. The case has a cover 353, also of cup-like configuration, which is coaxially related to the inner portion. The cover is mounted in any suitable manner, not shown, on the inner portion for pivotal adjustment relative thereto about the axis of the case. The inner portion has a rocker 355. As best shown in FIG. 12, the rocker includes a pivot which extends coaxially through the inner portion and mounts the rocker thereon for pivotal movement relative thereto. The rocker has an outer arm 356 and an inner arm 357 which extend individually and radially from the ends of the journal, the inner arm being disposed within the case and the outer arm being disposed between the case and the third wall.

The unit 350 has a temperature sensitive, bimetallic spring 360 which is of spiral configuration and is disposed concentrically within the cover 353. The center of the spring is fixedly connected to the cover for movement therewith in relation to the inner portion 352. The outer end of the spring is fixedly connected to the inner arm 357 in any suitable manner. The spring is constructed so that, as its temperature decreases, its outer end tends to move progressively in the direction indicated by the arrow 361 and to pivot the inner arm in this direction. Conversely, as the temperature of the spring increases, its outer end tends to move progressively in the direction opposite such direction and to move the inner arm in such opposite direction. The unit includes an electrical resistance heater 362 of annular form. The heater is coaxially related to the cover and is mounted thereon adjacent to the bimetallic spring and oppositely thereof from the inner arm. The heater is provided with a pair of electrical terminals 363 disposed externally of the cover. These terminals are electrically connected to any suitable source of electrical energy, not shown, which energizes the heater when an internal combustion engine connected to a third form of carburetor is operated. A typical such source is an electrical ignition circuit of such an engine so that the heater emits heat and the outer end of the bimetallic spring commences to move in a direction opposite the direction 361 as soon as operation of the engine commences.

The apparatus 300 has an arm 365 which interconnects the bore 325 of the lever 320 with the outer arm 356 of the thermostat unit 350. As a result, this lever is urged toward its position 321 as the bimetallic spring 360 cools and is urged toward its position 322 as such spring is warmed by the heater 362. It is apparent that as the temperature of the bimetallic spring decreases, the enrichment valve 130 is progressively opened thereby through the elements 306, 308, and 311, which move with the lever. Conversely, as the temperature of the bimetallic spring increases this valve is progressively closed by the spring.

OPERATION

The operation of the described embodiments of the subject invention is believed to be clearly apparent and is briefly summarized at this point.

First Form

As above stated, in the first form of carburetor of the subject invention, the enrichment valve 130 is automatically and progressively opened by the mechanism 180 and the rod 195 as the venturi plates 55 move toward their open positions 57, the valve being automatically and progressively closed by such mechanism and rod as the plates move toward their closed positions 56.

In one mode of using the first form, the relative positions of the plates 55 and the rotor 145 are adjusted, as previously described, so that the valve opens and closes with movement of the plates 55. This mode of opening and closing the plates is particularly adapted to condition the carburetor for use with different types of fuel, such as gasoline and methanol. For example, the primary system 100 is first configured for use with gasoline. The carburetor is then usable with gasoline by mounting a block 160 having no orifice 162 or such an orifice which so restricts the enrichment flow that satisfactory ratios of gasoline to air are provided.

To use the carburetor with methanol, the enrichment system 125 is then adjusted so that the enrichment flow 175 of methanol metered thereby, together with a primary flow 114 of methanol metered by the primary system when the primary system is configured for gasoline, provides satisfactory methanol to air ratios at all rates of air flow to an engine connected to the carburetor. Such adjustment of the enrichment system includes, of course, the mounting of a block 160 having an orifice 162 providing the proper characteristics for such enrichment flow of methanol. The first form of carburetor may then be rapidly and conveniently returned to its condition for gasoline operation by interchanging the blocks. When the first form of carburetor is so configured and adjusted, it is evident that the carburetor is conditioned for use with gasoline or with methanol simply by mounting the appropriate block. The first form is adaptable for similar conditioning for other different types of fuel. For example, by use of a block having an orifice of intermediate metering characteristics to those just described, the first form is conditioned for use with ethanol or with a mixture of ethanol and gasoline.

In a second mode of using the first form of carburetor, it is configured so that the enrichment valve 130 does not begin to open until the plates 55 are substantially open. As a result the enrichment system 125 only supplies fuel when an engine connected to the passage 25 is drawing air through the passage at a relatively high rate corresponding to a relatively high power output, such output requiring a richer than stoichiometric mixture, as is well known. It can be seen that, in such second mode, the first form is configured to provide such a mixture for high power when the enrichment valve is open and to provide a leaner mixture when this valve is closed for maximum fuel economy under cruising conditions where the power output is relatively low. It is apparent that, in such second mode, the primary fuel flow is sufficient for the engine when the plates 55 are disposed toward their closed position 56 and becomes insufficient as the plates approach their open position 57, the enrichment valve being closed while the plates are disposed toward their closed position and being progressively opened as the plates approach their open position. It is further apparent that, in the second mode, the enrichment valve is opened and closed by the mechanism 180 and the rod 195, which serve as a linkage connecting the portion 52 of the shaft 50 not bearing the cam 102 and the enrichment valve.

It is evident that, in both modes of using the first form of carburetor, the enrichment fuel flow 175 is increased by opening the enrichment valve 130 through the action of the mechanism 180 and the rod 195 when the sum of the primary flow 114 and the enrichment flow is insufficient for the desired operating condition of an engine connected to the carburetor. It is also evident that the mechanism and the rod serve to decrease the enrichment flow when such sum is more than sufficient. Such increasing and decreasing occurs under all conditions of engine operation with the first mode, as when methanol fuel is used, but occurs only at high power conditions with the second mode in which the primary flow is sufficient except under conditions of relatively high power.

Second Form

In the second form of carburetor embodying the subject invention, when the primary fuel flow 114 is insufficient for an engine connected to the carburetor or when the sum of this flow and the enrichment flow 175 is insufficient, the knob 215 is manually moved in the direction 216. The arms 207 and 208 are thereby moved in the directions 218, opening the enrichment valve 130 to increase the enrichment flow. Typically, the second form is used in this manner in an engine for a street vehicle to provide a stoichiometrically very rich mixture, for starting such an engine and/or for cold weather operation thereof. When the sum of the primary flow and the enrichment flow is more than sufficient for the engine, as when it warms up after starting with the knob initially drawn a substantial distance in the direction 216, the knob is moved in the direction 217 to decrease the enrichment flow.

Third Form

The third form of carburetor functions automatically under starting and cold weather conditions to increase the enrichment flow 175 when the primary flow 114 and/or the sum of such enrichment flow and such primary flow is insufficient for an engine connected to the third form of carburetor. In the third form, the primary system 100 is configured so that the primary flow alone is sufficient when the engine is "warmed up". Prior to starting a "cold" engine, the bimetallic spring 360 is relatively cold so that the lever 320 is urged into its position 321. The enrichment valve 130 is thereby opened fully or nearly so to provide a very rich mixture for starting such an engine. This movement of the lever moves the cam 332 to its fast idle position 333 so that the throttles are opened somewhat beyond their normal idle position as above described. As soon as the engine starts with the throttles so disposed, a substantial vacuum is developed in the portion of the passage 25 in the direction 28 from the throttles. This vacuum is communicated to the diaphragm assembly 342 by the conduit 346 so that the assembly moves the lever somewhat toward its position 332 partially closing the enrichment valve. As a result, the engine is provided immediately after starting with a mixture which is not so rich as that required for starting a cold engine.

As the engine warms up after starting from cold, the heater 362 progressively warms the bimetallic spring 360 a rate related to the decreasing need of the engine for a rich mixture as it warms up. As a result, the lever 320 is progressively moved toward its position 322, progressively closing the enrichment valve 130 and decreasing the enrichment flow 175 as the sum of this flow and the primary flow 114 becomes more than sufficient during warm up. Such progressive movement ultimately closes the valve and moves the cam 332 to the normal idle position 334. When this cam is so positioned and the enrichment valve closes fully, the carburetor of the third form is in a condition for warmed up engine operation.

Although the invention has been herein shown and described in what are conceived to be the most practical and preferred embodiments, it is recognized that departures may be made therefrom within the scope of the invention, which is not to be limited to the illustrative details disclosed.

Having described our invention, what we claim as new and desire to secure by Letters Patent is:

1. In a carburetor for use with a source of liquid fuel and an internal combustion engine and having a throat through which air is drawn during operation, a pair of venturi plates mounted in the throat for pivotal movement between relatively open and closed positions, resilient means urging the venturi plates from open to closed positions in opposition to air drawn through the throat, and a spray bar mounted in the throat; the combination of a primary fuel supply system interconnecting the source of fuel and the spray bar having a primary control valve therein; an enrichment fuel supply system interconnecting the source of fuel and the spray bar having an enrichment control valve therein; an automatic primary control linkage interconnecting one of the plates and the primary control valve for opening and closing the primary control valve in response to opening and closing of the plate to which it is connected; an automatic enrichment control linkage interconnecting the other of the plates and the enrichment control valve for opening and closing the enrichment control valve in response to opening and closing of said other plate; a block providing an orifice to condition the carburetor for use with different types of fuel; and means removably mounting the block in the enrichment fuel supply system with the orifice in series relation between the source of fuel and the spray bar.

2. A carburetor comprising

A. a housing having four generally planar walls which define a mixing passage which is of generally rectangular cross-section and is adapted for air flow therethrough in a predetermined direction, a fuel chamber mounted on one of the walls oppositely of the passage, and a cavity extended from the exterior of the housing, in one of said walls;

B. means for supplying fuel to the chamber;

C. a pair of shafts having individual axes extended across the passage in a direction substantially normal to the one wall, the shafts being disposed substantially normal to the one wall, the shafts being disposed in individually adjacent relation to the pair of the walls normal to the one wall and extending axially in parallel relation to said pair of walls and in normal relation to said direction, and each shaft having axially spaced portions individually journaled in the one wall and in the wall opposite thereto for pivotal movement of the shaft about its axis, the portion of each shaft journaled in the one wall being extended therethrough into the chamber;

D. a pair of venturi plates individually mounted on the shafts for pivotal movement therewith, each plate having a closed position in which the plate extends generally across the passage and an open position in which the plate extends generally parallel to said direction;

E. means for coordinating the pivotal movement of the shafts so that the plates move together between their closed positions and their open positions;

F. a fuel spray bar extending across the passage between said one wall and said wall opposite thereto centrally between said pair of walls normal to the one wall, the bar having a fuel channel extending therethrough between the one wall and the wall opposite thereto and having a port opening from the channel into the passage;

G. a primary fuel metering system having a primary valve which is mounted on the one wall within the chamber and has an inlet for the reception of fuel from the chamber and an outlet, a primary fuel passage extending through the housing between the outlet and the fuel channel for primary fuel flow from said valve to the channel, a cam which is disposed within the chamber and is mounted on the portion of one of the shafts journaled in the one wall for pivotal movement with said portion, and means for actuating the valve in response to pivotal movement of the cam, the cam progressively opening the valve in response to movement of the plates toward their open positions and progressively closing the valve in response to movement of the plates toward their closed positions;

H. an enrichment fuel metering system having an enrichment valve, which is mounted on said one wall and has an inlet opening into the enclosure and an outlet; an enrichment fuel passage which is extended through the housing in intersecting relation with said cavity therein and which is extended between the outlet of the enrichment valve and the fuel channel for enrichment fuel flow from said valve to the channel; and an element detachably fitted in the cavity in obstructing relation to the enrichment passage, said element being accessible from a position exteriorly of the housing for detachment therefrom and having an orifice which extends through the element and meters the enrichment flow in series with metering of such flow by the enrichment valve; and I. means for progressively opening and progressively closing the enrichment valve.

3. The carburetor of claim 2 wherein

A. the fuel channel has opposite ends individually adjacent to said one wall and the wall opposite thereof;

B. the primary fuel passage extends from the primary valve through said one wall to the end of the fuel channel adjacent thereto;

C. the enrichment fuel passage extends from the enrichment valve, successively, through said one wall, through one wall of said pair normal thereto and through said opposite wall to the end of the fuel channel adjacent to said opposite wall; and D. said cavity is disposed in the one wall of said pair.

4. A carburetor comprising

A. a housing having four generally planar walls which define a mixing passage which is of generally rectangular cross-section and is adapted for air flow therethrough in a predetermined direction, and a fuel chamber;

B. means for supplying fuel to the chamber;

C. a pair of shafts having individual axes extended across the passage in a direction substantially normal to one of the walls, the shafts being disposed in individually adjacent relation to the pair of the walls normal to the one wall and extending axially in parallel relation to said pair of walls and in normal relation to said direction, and each shaft having axially spaced portions individually journaled in the one wall and in the wall opposite thereto for pivotal movement of the shaft about its axis, the portion of each shaft journaled in the one wall being extended therethrough;

D. a pair of venturi plates individually mounted on the shafts for pivotal movement therewith, each plate having a closed position in which the plate extends generally across the passage and an open position in which the plate extends generally parallel to said direction;

E. a fuel spray bar extended across the passage between said one wall and said wall opposite thereto centrally between said pair of walls normal to the one wall, the bar having a fuel channel extending therethrough between the one wall and the wall opposite thereto; the bar being fixedly mounted on the housing and having a port opening from the channel into the passage; and the fuel channel having opposite ends individually adjacent to said one wall and the wall opposite thereof;

F. a primary fuel metering system having a primary valve which is mounted on the one wall and has an inlet for the reception of fuel from the chamber and an outlet, having a primary fuel passage extended through the housing between the outlet and the fuel channel for primary fuel flow from said valve to the channel, and having means operably connected to said portion of one of the shafts for actuating said primary valve in response to pivotal movement of said one shaft so that said valve progressively opens as the plates move toward their open positions and progressively closes as the plates move toward their closed positions, the primary fuel passage extending from the primary valve through said one wall to the end of the fuel channel adjacent thereto;

G. an enrichment fuel metering system having an enrichment valve, which is mounted on said one wall and has an inlet opening into the chamber and an outlet, and an enrichment fuel passage extended through the housing and between the outlet of the enrichment valve and the fuel channel for enrichment fuel flow from said valve to the channel, the enrichment fuel passage extending from the enrichment valve, successively, through said one wall, through one wall of said pair normal thereto and through said opposite wall to the end of the fuel channel adjacent to said opposite wall; and H. means for progressively opening and progressively closing the enrichment valve, thereby to increase the enrichment fuel flow when the sum of the enrichment flow and the primary flow is insufficient for the engine and to decrease the enrichment flow when the sum of the enrichment flow and the primary flow is more than sufficient for the engine.

5. The carburetor of claim 4 wherein said means for opening and closing the enrichment valve comprises a manually actuatable linkage extending from said valve to a point exterior to the housing.

6. The carburetor of claim 4 wherein said means for opening and closing the enrichment valve comprises a temperature sensitive element operably connected to the enrichment valve for opening said valve progressively as the temperature of the element decreases and for closing said valve progressively as the temperature of said element increases.

7. The carburetor of claim 4 wherein said means for opening and closing the enrichment valve comprises an element mounted on said portion of the other of the shafts for pivotal movement therewith and linkage operably connecting said element to the enrichment valve so that the enrichment valve automatically and progressively opens as the venturi plates move toward their open positions and so that the enrichment valve automatically and progressively closes as the plates move toward their closed positions.

8. The carburetor of claim 7 wherein the primary fuel flow is sufficient for the engine when the plates are disposed toward their closed position and becomes insufficient as the plates approach their open position and wherein the means for opening and closing the enrichment valve is a linkage operably connecting said portion of the other of the shafts and the enrichment valve so that the enrichment valve is closed while the plates are disposed toward their closed position and progressively opens as the plates approach their open position.

9. The carburetor of claim 4 wherein the housing has a cavity extended from the exterior thereof in intersecting relation with the enrichment passage and wherein the enrichment system further comprises an element detachably fitted in the cavity in obstructing relation to the enrichment passage, said element being accessible from a position exteriorly of the housing for detachment therefrom and having an orifice which extends through the element and meters the enrichment flow in series with metering of such flow by the enrichment valve.

10. The carburetor of claim 4 further comprising means for coordinating the pivotal movement of the shafts so that the plates move together between their closed positions and their open positions.

* * * * *